US009517571B2

(12) United States Patent
Wilhelm et al.

(10) Patent No.: US 9,517,571 B2
(45) Date of Patent: Dec. 13, 2016

(54) CIRCULAR CUTTING BLADE

(75) Inventors: Eric C. Wilhelm, Southbridge, MA (US); Richard M. Clemence, Southbridge, MA (US); William Hill, Ball Ground, GA (US); Richard N. Cloutier, Woodstock, CT (US)

(73) Assignee: HYDE TOOLS, INC., Southbridge, MA (US)

( * ) Notice: Subject to any disclaimer, the term of this patent is extended or adjusted under 35 U.S.C. 154(b) by 1218 days.

(21) Appl. No.: 12/930,006

(22) Filed: Dec. 23, 2010

(65) Prior Publication Data

US 2011/0179932 A1 Jul. 28, 2011

Related U.S. Application Data

(60) Provisional application No. 61/336,782, filed on Jan. 26, 2010.

(51) Int. Cl.
*B27B 33/08* (2006.01)
*B26D 1/00* (2006.01)
*B26D 1/14* (2006.01)

(52) U.S. Cl.
CPC ..... *B26D 1/0006* (2013.01); *B26D 1/14* (2013.01); *B26D 2001/006* (2013.01); *B26D 2001/0046* (2013.01); *B26D 2001/0053* (2013.01); *Y10T 83/9403* (2015.04)

(58) Field of Classification Search
CPC . B26D 1/0006; B26D 1/14; B26D 2001/0046; B26D 2001/0053; Y10T 83/9403
USPC ..... 83/676, 835–855, 932; 30/355
See application file for complete search history.

(56) References Cited

U.S. PATENT DOCUMENTS

| | | | | |
|---|---|---|---|---|
| 139,176 | A * | 5/1873 | Miller | 83/676 |
| 3,125,139 | A * | 3/1964 | Weinzierl | B23D 45/105 83/404.4 |
| 4,034,638 | A * | 7/1977 | Drum | 83/835 |
| 5,022,299 | A * | 6/1991 | Fischer et al. | 83/676 |
| 5,129,296 | A * | 7/1992 | Wayne | 83/19 |
| 5,713,259 | A * | 2/1998 | Haanschoten | 83/835 |
| 6,267,033 | B1 * | 7/2001 | Gundlach et al. | 83/42 |
| 6,691,596 | B1 * | 2/2004 | Singh et al. | 83/13 |
| 6,813,835 | B2 * | 11/2004 | Deville | 30/254 |
| 7,856,913 | B2 * | 12/2010 | Matzunsky | B26D 1/0006 83/341 |
| 2003/0209125 | A1 * | 11/2003 | Bertolet | 83/835 |

(Continued)

*Primary Examiner* — Omar Flores Sanchez
(74) *Attorney, Agent, or Firm* — Louis J. Franco; Law Office of Louis J. Franco

(57) ABSTRACT

A circular cutting blade is configured for cutting meat when turned about a rotation axis in a predetermined cutting direction. The cutting blade has a peripheral blade edge defined between the first and second sides and a plurality of circumferentially disposed cutting knives. Each cutting knife includes first and second knife sides and an arcuate knife edge that constitutes a portion of the peripheral blade edge. Each knife edge rises, relative to the rotation axis, between a first blade-edge location corresponding to a minor blade radius and a second blade-edge location corresponding to a major blade radius and further includes beveled primary and secondary knife-edge portions along which the first and second knife sides mutually converge at, respectively, a first bevel angle and a second bevel angle less acute than the first bevel angle.

4 Claims, 2 Drawing Sheets

(56) References Cited

U.S. PATENT DOCUMENTS

| | | | | |
|---|---|---|---|---|
| 2006/0021487 | A1* | 2/2006 | Dickover et al. | 83/835 |
| 2007/0234870 | A1* | 10/2007 | Brabfilev | 83/852 |
| 2007/0251368 | A1* | 11/2007 | McFarlane | 83/649 |
| 2008/0000337 | A1* | 1/2008 | Dickover et al. | 83/651 |
| 2014/0013916 | A1* | 1/2014 | Athad | 83/676 |

* cited by examiner 30X 12.0°
80
26
$L_{BE2}$
90
70
50
$R_{MAJ}$
54
60
52
$R_{MIN}$
$L_{BE1}$ 54
52
$\theta_{B1}$
70
24
22
10
II
III
26
24
22
60
20
50
$D_C$
$A_R$
$L_{BR}$
Ø.188
$MP_A$
$L_B$
$L_T$
R3.500
WP
$P_B$

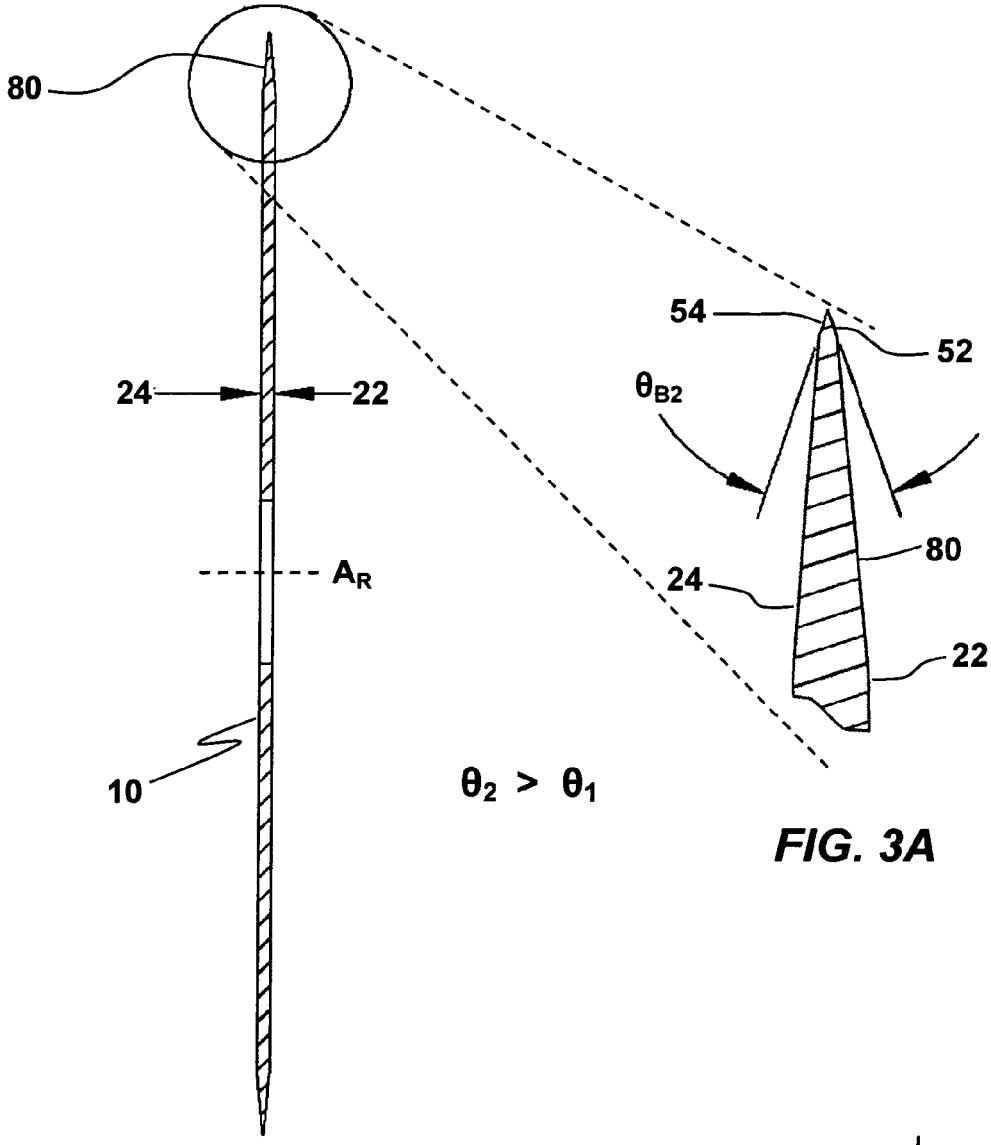
FIG. 3
FIG. 3A
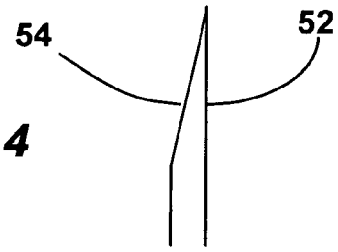
FIG. 4

CIRCULAR CUTTING BLADE

PROVISIONAL PRIORITY CLAIM

Priority based on Provisional Application Ser. No. 61/336,782 filed Jan. 26, 2010, and entitled "CIRCULAR CUTTING BLADE" is claimed. Moreover, the entirety of the previous provisional application, including the drawings, is incorporated herein by reference as if set forth fully in the present application.

BACKGROUND

Traditionally, circular meat saw blades, such as those to cut poultry, are of two general types. Included within a first type of meat blade are blades that end consumers observe at deli counters. Circular deli-style blades are used to cut products such as cheese, processed meats, such as "cold cuts," and pre-cooked non-processed meats, such as ham and turkey. Circular deli blades are typically characterized by a sharp, beveled cutting edge, as viewed into a cross-sectional plane that includes the rotation axis, and a constant, circular radius as viewed from either side. Blades of this first type are generally unsuitable for use in the initial butchering stages in which the meats being cut are raw and include bone, cartilage, tendon, and non-edible soft tissue.

In order to butcher meats, including poultry, shortly after slaughter, a second type of circular meat saw blade is used. As viewed from either side, a circular blade of the second type is typically marked by a plurality of circumferentially disposed U-shaped notches that are convex relative to the rotation axis of the blade. The particular purpose for which such a blade is designed is a factor in determining how deep the notches are defined and for what length each extends along the circumference of the blade. As a general proposition, however, it is known in the meat industry that such blades, while robust and sufficiently "aggressive" to cut through bone and cartilage, for example, result in non-negligible losses of otherwise edible and salable meat product. This undesired shredding and "tearing off" of meat is currently factored as a price of doing business.

Accordingly, there exists a need for a circular meat cutting blade that, while sufficiently robust to cut through animal bone and cartilage, minimizes the loss of meat product associated with traditional meat cutting blades.

SUMMARY

In each of various alternative embodiments, a circular cutting blade, such as a meat saw blade, is configured for unidirectional rotation about an axis in a predetermined cutting direction. The blade comprises a substrate with first and second substrate sides. A peripheral blade edge is defined between the first and second sides and by a plurality of circumferentially disposed cutting knives.

Each cutting knife includes first and second knife sides corresponding with, respectively, the first and second substrate sides, and an arcuate knife edge. In one embodiment, the first and second knife sides are defined portions of, respectively, the first and second substrate sides. The knife edge of each cutting knife rises, relative to the rotation axis, between a first blade-edge location corresponding to a minor blade radius and a second blade-edge location corresponding to a major blade radius.

Defined along the knife edge of each cutting knife are beveled primary and secondary knife-edge portions. Along the primary knife-edge portion, the first and second knife sides mutually converge at a first bevel angle. Distinguishably, along the secondary knife-edge portion, the first and second knife sides mutually converge at a second bevel angle that is larger (i.e., less acute) than the first bevel angle.

In various versions, the secondary knife-edge portion of each cutting knife is situated behind the primary knife-edge portion such that, relative to the cutting direction, each primary knife-edge portion leads the secondary knife-edge portion of the same knife into a work piece (e.g., meat or bone) to be cut. Stated alternatively, when the blade is rotated in the cutting direction, a fixed external point located (e.g. a work piece or a location on a work piece) adjacent the peripheral blade edge is encountered first by the primary knife edge of each cutting knife or, more generally in, for example, versions in which each cutting knife lacks distinct primary and secondary knife-edge portions of disparate bevel angles, by the first blade-edge location corresponding to the minor blade radius. While each primary knife-edge portion is sharper than the secondary knife-edge portion of the same knife, as defined by the relativity of the first and second bevel angles, it is also not as strong. Moreover, due to the "rise" of each arcuate knife edge, the (radially directed) force between the work piece and the knife edge increases from an initial magnitude when the knife edge first enters the work piece. By situating the sharper primary knife-edge portion forward of the secondary knife-edge portion, an initial cut is made in the work piece by the sharper portion of the knife, while, as the forces increase, the secondary knife-edge portion "takes over" and adds a finishing cut to the initial cut. In other words, initially, the benefit of a sharper edge is realized when the forces are relatively low, while the benefit of a stronger (duller) edge are realized when the forces are relatively high.

Among the benefits of the prescribed locations of the primary and secondary knife-edge portions, and the configuration of same, is prolonged blade life. However, various embodiments within the scope and contemplation of the invention are configured for use in the meat industry, generally, and the poultry industry, more particularly. The aforementioned configuration and arrangement of the primary and secondary knife-edge portions obviates the tearing of meat associated with existing blades and, therefore, results in cleaner, less wasteful cuts.

Representative embodiments are more completely described and depicted in the following detailed description and the accompanying drawings.

BRIEF DESCRIPTION OF THE DRAWINGS

FIG. 3 is a cross-sectional view into the plane III of FIG. 1;

FIG. 3A is a detail view of the sectional blade portion indicated in FIG. 3; and FIG. 4 is a cross-sectional view of a cutting knife in which the knife sides converge in a single bevel.

DETAILED DESCRIPTION

Figures 1, 1A, 2, 2A:
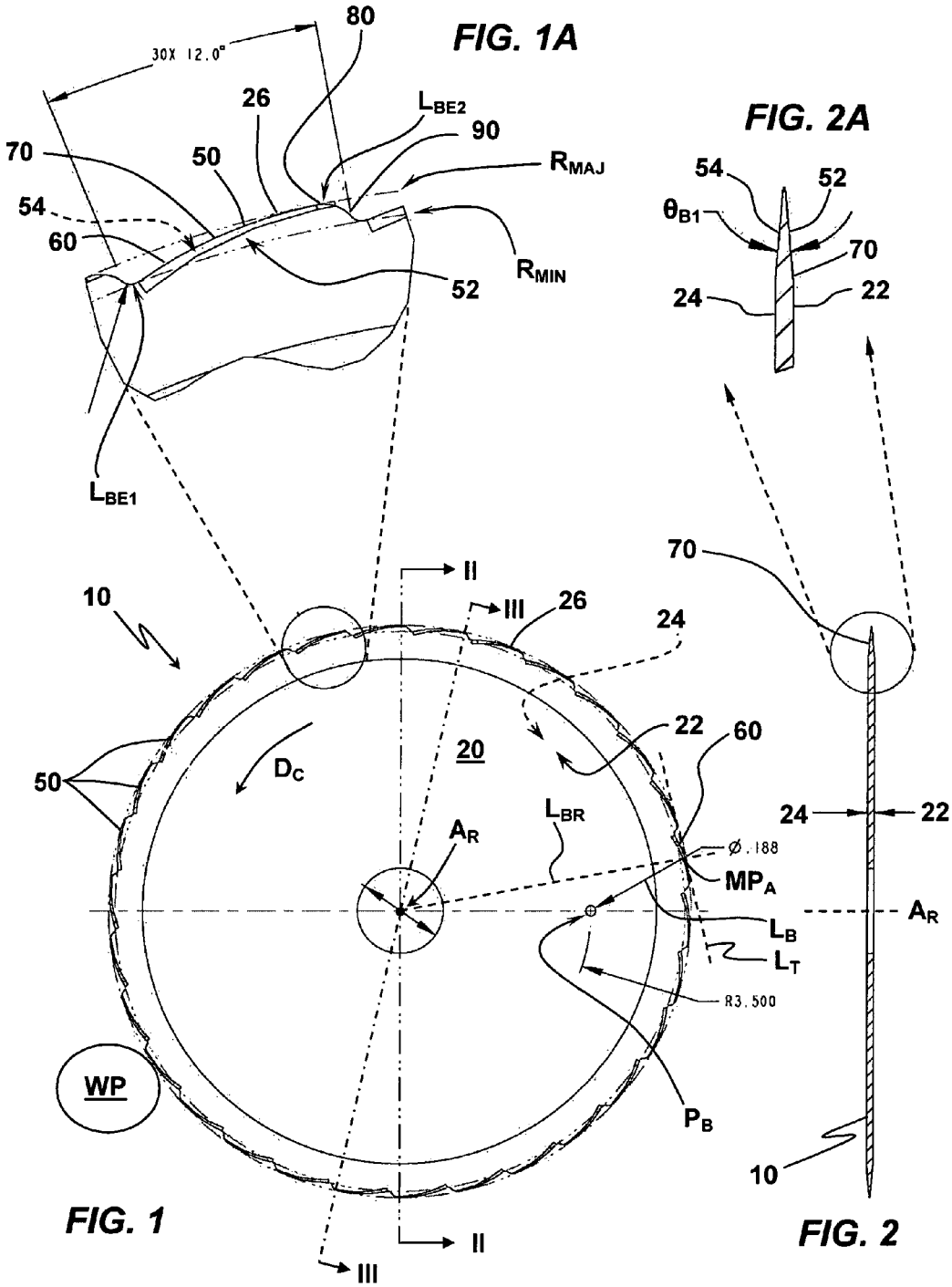
FIG. 1 is a side view of a circular cutting blade.
FIG. 1A is a detail view of the blade portion indicated in FIG. 1.
FIG. 2 is a cross-sectional view into the plane II of FIG. 1.
FIG. 2A is a detail view of the sectional blade portion indicated in FIG. 2.

The following description of variously embodied circular cutting blades is demonstrative in nature and is not intended to limit the invention or its application of uses. Accordingly, the various implementations, aspects, versions and embodiments described in the summary and detailed description are in the nature of non-limiting examples falling within the scope of the appended claims and do not serve to define the maximum scope of the claims.

With initial reference to FIG. 1, an illustrative circular cutting blade 10 is configured for cutting a work piece WP when turned about a rotation axis $A_R$ in a predetermined cutting direction $D_C$ which, in FIG. 1, is indicated as counterclockwise. The cutting blade 10 comprises a planar substrate 20 having opposed first and second substrate sides 22 and 24, and a peripheral blade edge 26 defined between the first and second sides 22 and 24. In various illustrative versions, the substrate 20 is fabricated from a rigid, wear-resistant material such as steel, or alternative metal, or a ceramic, by way of non-limiting example.

As shown in FIG. 1 and the detail view of FIG. 1A, the substrate 20 has formed thereon a plurality of circumferentially disposed cutting knives 50. Each cutting knife 50 includes first and second knife sides 52 and 54 corresponding with, respectively, the first and second substrate sides 22 and 24, and an arcuate knife edge 60 that constitutes a portion of the overall peripheral blade edge 26 and is oriented such that the arc defined thereby is concave relative to the rotation axis $A_R$. Alternatively stated, each cutting knife 50 presents a convex arcuate knife edge 60 to a work piece WP undergoing cutting.

In various versions, the arcuate knife edges 60 are circular arcs. Irrespective of constancy in the radius of curvature, however, the arcuate knife edge 60 of each cutting knife 50 is "tilted" relative to the rotation axis $A_R$ such that the knife edge 60 rises between a first blade-edge location $L_{BE1}$ corresponding to a minor blade radius $R_{MIN}$ and a second blade-edge location $L_{BE2}$ corresponding to a major blade radius $R_{MAJ}$. For example, in an illustrative version in which each knife edge 60 defines a circular arc, the knife edge 60 is "tilted" such that a radial arc-bisecting line $L_B$ that bisects the knife edge 60 at an arc mid-point $MP_A$ (i) has as its origin a point $P_B$ that does not spatially coincide with the rotation axis $A_R$ and (ii) is non-parallel with a blade radius line $L_{BR}$ extending from the rotation axis $A_R$ through the arc mid-point $MP_A$. Stated more generally for the inclusion of cases in which a knife edge 60 defines a non-circular arc, the knife edge 60 is tilted such that an arc-bisecting line $L_B$ that bisects that arcuate knife edge 60 at an arc mid-point $MP_A$, and that is oriented orthogonally to a tangent line $L_T$ including the arc mid-point $MP_A$, is non-parallel to a blade-radius line $L_{BR}$ extending from the rotation axis $A_R$ through the arc mid-point $MP_A$.

As indicated most clearly in FIG. 1A, each cutting knife 50 further includes beveled primary and secondary knife-edge portions 70 and 80. As shown in FIG. 2, which is a cross-sectional view into the plane II of FIG. 1, and the detail view of FIG. 2A, the primary knife-edge portion 70 is beveled such that the first and second knife sides 52 and 54 mutually converge at a first bevel angle $\theta_{B1}$. However, as shown in FIG. 3, which is a cross-sectional view into the plane III of FIG. 1, and the detail view of FIG. 3A, along the secondary knife-edge portion 80, the first and second knife sides 52 and 54 mutually converge at a second bevel angle $\theta_{B2}$ that is less acute than the first bevel angle $\theta_{B1}$. Although the examples of FIGS. 2 through 3A depict the first and second knife sides 52 and 54 converging symmetrically about the blade plane (not labeled) in a so-called "double bevel," it is to be understood that, absent express limitations to the contrary, the invention as defined in the appended claims is not so limited. For example, within the scope of various claims is the "single bevel" version of FIG. 4 in which the first knife side 52 is parallel to the blade plane, while the second knife side 54 is angled toward the first knife side 52. In the broadest aspects of the invention, therefore, the only condition that need be met is that the first and second knife sides 52 and 54 mutually converge to define a bevel which, in illustrative alternative versions, is a double bevel or single bevel.

In the particular version shown in FIGS. 1 and 1A, the secondary knife-edge portion 80 of each cutting knife 50 has a shorter cutting length than the primary knife-edge portion 70 of the same cutting knife 50. However, it is to be generally understood that the version of FIGS. 1 and 1A is merely illustrative and, more particularly understood, that, absent explicit limitations to the contrary, within the scope and contemplation of the invention as defined in the appended claims are versions in which the cutting length of the secondary knife-edge portion 80 is equal to or greater than the cutting length of the primary knife-edge portion 70.

With continued reference to FIGS. 1 and 1A, the peripheral blade edge 26 further includes a back slope 90 situated between first and second cutting knives 50 of each set of two adjacent cutting knives 50. Furthermore, each back slope 90 is situated, relative to the cutting direction $D_C$, behind the secondary knife-edge portion 80 of a first cutting knife 50 and in front of the primary knife-edge portion 70 of a second cutting knife 50 located behind, and adjacent to, the first cutting knife 50. Although no particular profile of a back slope 90 is shown as viewed into cross-sectional plane including the blade rotation axis $A_R$, such as planes II and III, for example, the back slopes 90 between cutting knives 50 of a first version are non-beveled while, in a second version, the back slopes 90 are beveled. It will be appreciated that non-beveled back slopes 90 contribute strength and rigidity to the peripheral blade edge 26. Moreover, as with the version of FIGS. 1 and 1A, a typical version is configured such that, as viewed from either side of the cutting blade 10, each back slope 90 slopes more steeply (less gradually) than the rates at which the knife edges 60 between which that back slope 90 is situated rise.

The foregoing is considered to be illustrative of the principles of the invention. Furthermore, since modifications and changes to various aspects and implementations will occur to those skilled in the art without departing from the scope and spirit of the invention, it is to be understood that the foregoing does not limit the invention as expressed in the appended claims to the exact constructions, implementations and versions shown and described.

What is claimed is:

1. A circular blade configured for cutting meat when turned about a rotation axis in a predetermined cutting direction, the cutting blade comprising:

a peripheral blade edge; and a plurality of circumferentially disposed cutting knives, each of which cutting knives includes (i) first and second knife sides, (ii) an arcuate knife edge that constitutes a portion of the peripheral blade edge and rises, relative to the rotation axis, between a first blade-edge location corresponding to a minor blade radius and a second blade-edge location corresponding to a major blade radius, and (iii) beveled primary and secondary knife-edge portions along which the first and second knife sides mutually converge at, respectively, a first bevel angle and a second bevel angle less acute than the first bevel angle, wherein (a) each knife edge is tilted such that an arc-bisecting line that bisects the knife edge at an arc mid-point, and that is oriented orthogonally to a tangent line including the arc mid-point, is non-parallel to a blade-radius line extending from the rotation axis through the arc mid-point;

(b) the secondary knife-edge portion of each cutting knife is situated, relative to the cutting direction, behind the primary knife-edge portion of the same cutting knife such that, when the circular blade is rotating and cutting a work piece, the work piece first encounters the primary knife-edge portion of each cutting knife before encountering the secondary knife-edge portion of that cutting knife;

(c) the secondary knife-edge portion of each cutting knife has a shorter cutting length than the primary knife-edge portion of the same cutting knife;

(d) the peripheral blade edge further comprises a plurality of back slopes, each back slope is situated, relative to the cutting direction, behind the secondary knife-edge portion of a first cutting knife and in front of the primary knife-edge portion of a second cutting knife located behind, and adjacent to, the first cutting knife; and (e) each back slope slopes more steeply than the knife edges between which that back slope is situated.

2. The circular cutting blade of claim 1 wherein each back slope is non-beveled.

3. The circular cutting blade of claim 2 wherein the first and second knife sides of each cutting knife mutually converge to define a double bevel.

4. The circular cutting blade of claim 1 wherein the first and second knife sides of each cutting knife mutually converge to define a double bevel.

* * * * *